US006945171B1

(12) United States Patent
Coull

(10) Patent No.: US 6,945,171 B1
(45) Date of Patent: Sep. 20, 2005

(54) METHOD OF PRINTING

(75) Inventor: Alan Coull, Nottingham (GB)

(73) Assignee: Markem Technologies Limited, (GB)

( * ) Notice: Subject to any disclaimer, the term of this patent is extended or adjusted under 35 U.S.C. 154(b) by 407 days.

(21) Appl. No.: 09/831,331

(22) PCT Filed: Sep. 7, 2000

(86) PCT No.: PCT/GB00/03411

§ 371 (c)(1),
(2), (4) Date: Jan. 24, 2002

(87) PCT Pub. No.: WO01/17791

PCT Pub. Date: Mar. 15, 2001

(30) Foreign Application Priority Data

Sep. 8, 1999 (GB) ..... 9921081

(51) Int. Cl.[7] ..... B41J 2/325
(52) U.S. Cl. ..... 101/288; 347/176
(58) Field of Search ..... 101/288, 486, 101/93, 485, 35; 53/411, 131.2, 131.3, 131.4, 53/131.5; 347/197, 172, 173, 174, 176, 171; 400/120.01, 120.02

(56) References Cited

U.S. PATENT DOCUMENTS 3,728,962 A 4/1973 Sherrington ..... 101/288
4,398,457 A 8/1983 Takahashi et al.
5,784,171 A * 7/1998 Kano ..... 358/296
5,810,487 A * 9/1998 Kano et al. ..... 400/83
5,815,282 A 9/1998 Kano ..... 358/296
5,818,492 A * 10/1998 Look ..... 347/171
5,847,743 A * 12/1998 Look ..... 347/176

FOREIGN PATENT DOCUMENTS

EP 10100508 4/1998
GB 2 335 885 10/1999

OTHER PUBLICATIONS

GB9921081.7 Search Report.

* cited by examiner

*Primary Examiner*—Andrew H. Hirshfeld
*Assistant Examiner*—Leo T. Hinze
(74) *Attorney, Agent, or Firm*—Fish & Richardson P.C.

(57) ABSTRACT

A method of printing information on each article of a set of articles arranged in generally parallel lanes at a printing station, the method including continuously moving a printing apparatus relative to the lanes to bring the printing apparatus into registry with each article of the set in turn, and at each registry position, whilst continuing to move the printing apparatus, moving a print head of the apparatus relative to the respective article to a printing position in which the print head is capable of printing information on the article, continuing to move the printing apparatus relative to the article whilst effecting printing with the print head, and when the information is printed, whilst continuing to move the printing apparatus, moving the print head out of the printing position.

13 Claims, 1 Drawing Sheet

METHOD OF PRINTING

DESCRIPTION OF INVENTION

This invention relates to a method of printing.

It is a requirement to be able to print on each article of a set of articles which are conveyed to a printing station in generally parallel lanes.

For example in a packaging line, a plurality of articles on each of which it is desired to print information, may be conveyed side by side on a conveying means, to a printing station where the information is to be printed.

So called intermittent printers are known in which a print head is moved relative to a stationary substrate whilst printing elements of the print head are actuated to print desired information on the substrate. Such printers may be thermal printers in which pixels of ink are removed from a ribbon as the printing elements are energised, and thus the print head, during printing, moves not only relative to the substrate, but relative to the ribbon too.

By virtue of the need to move the print head relative to the stationary substrate, the length of information which can be printed along the stationary substrate is restricted.

It is known to use an intermittent printer of the type described above, to achieve printing on each article of a set of articles which are conveyed side by side in generally parallel lanes to a printing station where the printer is located. The printer is mounted on a carriage and is bodily conveyed transversely across the lanes. The articles are maintained stationary at the printing station and the printer is conveyed transversely of the lanes to a first position where movement of the printer is stopped, and then printing is effected on a first of the articles by moving the print head within the stationary printing apparatus. The printer is then conveyed transversely of the lanes to a second position where movement of the printer is again stopped, so that printing may be effected on a second article, and so on for all of the articles of the set.

Although intermittent printers are not particularly fragile, the continual stopping and starting of the carriage creates wear and tear on the intermittent printer. The problem is aggravated because of the speed at which it necessary to convey the printer between stops in order to reduce the time between printing on the articles to a minimum. Thus not only is the printer subjected to jolts as the printer stops, but rapid accelerations when the printer is moved between stops. Also, the carriage and its ancillary drive system is subject to wear and tear aggravated by the start/stop motion of the printer.

So called continuous thermal printers are also known in which a print head is held stationary at a printing station and during printing, the substrate and ribbon are moved past the print head, usually together, whilst the printing elements of the print head are selectively energised, to effect printing. The length of print is not restricted as in an intermittent printer because the print head is not moved in the printer, but relative movement between the print head, and the ribbon and substrate, is achieved solely by movement of the ribbon and substrate. Such printers tend to be used where the substrate is a moving web, which can readily be moved together with the ribbon past the print head, whereas intermittent printers are more readily adaptable for printing on other substrates such as articles on a packaging line, because relative movement between the print head, and the ribbon and substrate, is achieved by print head movement.

According to one aspect of the invention we provide a method of printing information on each article of a set of articles arranged in generally parallel lanes, at a printing station, the method including continuously moving a printing apparatus relative to the lanes to bring the printing apparatus into registry with each article of the set in turn, and at each registry position, whilst continuing to move the printing apparatus, moving a print head of the apparatus relative to the respective article to a printing position in which the print head is capable of printing information on the article, continuing to move the printing apparatus relative to the article whilst effecting printing with the print head, and when the information is printed, whilst continuing to move the printing apparatus, moving the print head out of the printing position.

Thus utilising the invention, it is unnecessary to arrest movement of the printing apparatus as the printing apparatus moves across the lanes of articles, but at each registry position, it is only necessary to move the print head within the printing apparatus to the printing position. Thus the problems mentioned above with using an intermittent type of printer in this context are largely overcome.

Preferably the printing apparatus is mounted on a carriage and the method includes continuously moving the carriage, preferably at a generally constant speed, transversely across the lanes, relative to a base structure relative to which each of the articles of the set is held stationary during printing. All of the articles of the set may be positioned at the printing station simultaneously whilst the printing apparatus is moved transversely across all the lanes, or the articles may be conveyed severally, e.g. in turn, in their respective lanes, to the printing station, provided that the articles each are present at the printing station so that the printing apparatus may be moved into registry with the articles and printing performed, whilst the printing apparatus is continuously moved.

The printing apparatus may include a housing mounted on the carriage, and print head movement to and from the printing position may be relative to the housing of the printing apparatus.

The print head may be of the kind having a plurality of printing elements which are selectively actuated during printing by a control means to effect printing of desired information on each of the articles. The information printed may be the same for each of the articles, or different for at least one of the articles compared with the other articles.

In one embodiment the printing apparatus is a thermal printer in which there are printing elements arranged in a generally linear array along the print head with the array extending generally transversely to the direction of movement of the printing apparatus across the lanes, the method including selectively energising the printing elements during printing to remove pixels of marking medium such as a thermal ink, from a carrier positioned between the printing elements and the article. Thus in moving the print head to the printing position, the printing elements are brought into a position in which the elements, when energised, are able to remove pixels of marking medium from the carrier, and when the print head is moved out of the printing position e.g. away from the article, the printing apparatus may be moved relative to the article with the printing elements out of contact with the carrier or at least with the carrier out of contact with any of the articles.

The method may include moving the carrier relative to the print head as the printing apparatus moves transversely of the lanes of articles during printing, so as that fresh carrier may continually be positioned between the print head and the article on which information is being printed. By "fresh" carrier we mean a new area of carrier from which pixels of marking medium to be moved during subsequent printing have not been removed in previous printing.

The printing apparatus may include a housing within which there is provided a storage spool for unused carrier, a take-up spool for used carrier, a first motive means to move at least the take-up spool to take up used carrier, and a second motive means to move the print head to and from the printing position.

In one arrangement, the method may include conveying the articles of the set in their parallel lanes to the printing station, arresting movement of the set of articles at the printing station while the information is printed on each of the articles of the set.

According to a second aspect of the invention we provide a method of printing information on each article of a set of articles arranged in generally parallel lanes, at a printing station, the method including continuously moving a printing apparatus relative to the lanes to bring the printing apparatus into registry with each article of the set in turn, the printing apparatus including a print head and a carrier for marking medium which is applied to the articles during printing, and at each registry position, whilst continuing to move the printing apparatus, effecting printing with the print head, and when the information is printed, continuing to move the printing apparatus to the next registry position.

The invention may be applied to a thermal print head in which printing elements are selectively energised during printing to melt and remove pixels of marking medium from the carrier and deposit the pixels of ink on to the articles. Alternatively, the invention may be applied to an alternative kind of printer, such as an ink jet type printer in which the marking medium is contained in a reservoir and selectively applied by jetting, onto the articles to print the information.

The method of the second aspect of the invention may have any of the features of the method of the first aspect of the invention.

According to a third aspect of the invention we provide a printing station for performing the method of the first or second aspect of the invention, the printing station including a carriage, a printing apparatus, means to mount the printing apparatus on the carriage, means to move the carriage and thus the printing apparatus transversely of a plurality of lanes and to effect printing on each of a plurality of articles at the printing station, each of the articles being located in one of the lanes, characterised in that the means to move the carriage is adapted to move the carriage substantially continuously across the lanes and the printing apparatus being adapted to print the information on each of the articles of the set in turn without or substantially without stopping.

In one embodiment, the carriage may be mounted on a gantry which extends over or under the lanes and the printing apparatus is moved over or under the lanes respectively, on the carriage.

The gantry and/or the carriage may include a drive means for moving the carriage, as desired. Movement of the carriage may be controlled by a control means which co-ordinates printing with carriage movement.

The invention will now be described with reference to the accompanying drawings in which.

Figure 1:
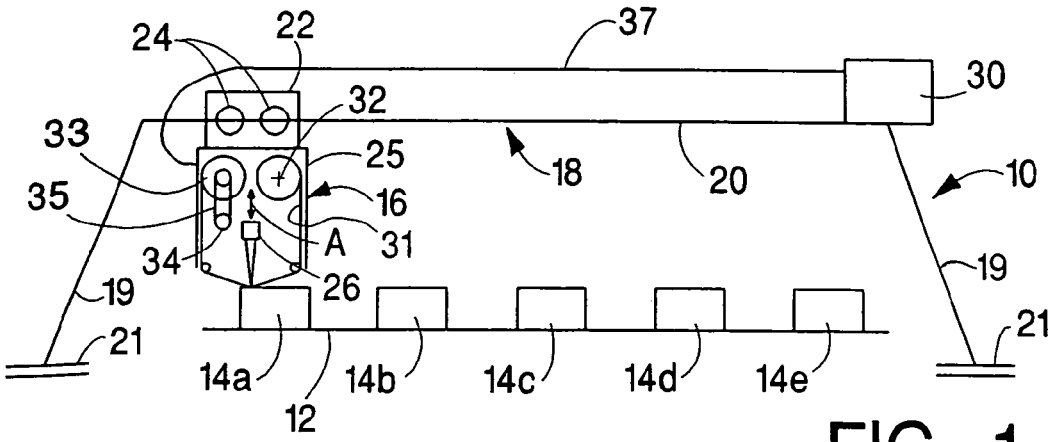
FIG. 1 is a side illustrative view of a printing station which may be operated in accordance with the invention, at the commencement of printing on each article of a set of articles.

Referring to the drawings, a printing station 10 is located adjacent a conveying means 12 e.g. of a packaging line, the conveying means 12 being arranged to convey sets of articles, two of which are shown at 14*a* to 14*e* and 15*a* to 15*e,* to and from i.e. past the printing station 10, with the articles arranged in generally parallel lanes a to e. Thus the articles of a set, e.g. articles 14*a* to 14*e* are, at the printing station 12, side by side. In this example, the articles 14*a* to 14*e* of the set all arrive at the printing station 10 together, although they may arrive severally, provided that each article 14*a* to 14*e* is present at the printing station 10 prior to a printing apparatus 16 being moved as hereinafter described, into registry with the articles, for printing.

In the example illustrated, the conveying means 12 is a belt or roller conveyor on which the articles 14*a* to 14*e* and 15*a* to 15*e* are moved relative to a base structure 21, but the invention may be utilised with other kinds of conveyor which are adapted to deliver a set of articles in lanes to a printing station 10.

As shown, the printing station 10 includes a gantry 18 mounted on the base structure 21 relative to which the conveying means 12 conveys the articles 14*a* to 14*e* and 15*a* to 15*e,* the gantry 18 having upstanding supports 19 at either side of the conveying means 12, and a generally horizontal rail part 20 although any other construction, e.g. a suspended construction, may be used to provide a rail or the like along which a carriage 22 carrying the printing apparatus 16 may be provided.

The carriage 22 is in this example suspended from the gantry rail part 20, but may be mounted on the rail part 20, or the rail part may be arranged to pass through the carriage 22 as desired. The carriage 22 has wheels or rollers 24 which ride on the rail part 20 to facilitate carriage 22 movement along the rail part 20. The carriage 22 in this example includes a drive means (not shown) which applies drive, through a suitable transmission (not shown) to the wheels or rollers 24 to effect carriage 22 movement along the rail part 20 transversely of the lanes a to e of articles 14*a* to 14*e* and 15*a* to 15*e.* In another embodiment, the carriage 22 may be driven by an external drive means, such as a motor connected by cables to the carriage 22, or by a lead screw with which a threaded member of the carriage 22 co-operates.

The requirement is for the carriage 22 to be moveable transversely of a set of articles 14*a* to 14*e* positioned at the printing station 10, preferably in a continuous or substantially continuous movement as hereinafter described.

The carriage 22 is fixed relative to the print apparatus 16, and the printing apparatus (16) includes a housing 25 in which is contained a print head 26 which in this example is a thermal print head 26 having a linear array 27 of thermal printing elements 28 each of which may selectively be energised under the control of a control means 30, such as computer, to remove pixels of marking medium such as a thermoplastic ink, from a carrier ribbon 31, as the print head 26 and ribbon 31 are relatively moved, and to deposit the ink onto an adjacent article.

The ribbon 31 is provided on a supply spool 32 mounted in the housing 25, and is wound on to a take-up spool 33 in use. In this example, the take-up spool 33 is driven from its own motive means 34 e.g. via a belt 35 or gear drive. In another example, the take-up spool may be driven from the drive means of the carriage 22.

The ribbon 31 is located between the print head 26 and an article 14*a* to 14*b* of the set of articles onto which information is to be printed, and the print head 26 is movable by a motive means (not shown) for movement towards and away from the articles 14*a* to 14*e* as indicated in FIG. 1 by the arrow A. When moved towards an article 14*a* to 14*e,* as seen in FIG. 1, to a printing position, the ribbon 31 is urged into contact with the article and as the printing elements 27 are selectively energised, the ink is melted and transferred from the ribbon 31 on to the article. When the print head 26 is moved away from the article out of the printing position, relative movement occurs between the print head 26 and the article 14*a* to 14*e* without any ink being removed from the ribbon and deposited on to an article, as the ribbon will be out of contact with the article, and typically out of contact with the print head 26 too.

The control means 30 in this example is connected to the printing apparatus 16, and to the drive means of the carriage 22 as desired, via a travelling lead 37, as is well known in the art, although the control means 30 or part of the control means may be mounted in or on the printing apparatus 16 or carriage 22 as desired.

A method in accordance with the invention will now be described.

A set of articles, 14*a* to 14*e* are conveyed by the conveying means 12 to the printing station 10, where they are held stationary. This may be achieved by the control means 30 co-ordinating article movement to stop the conveying means 12 when the articles 12*a* are in the positions shown in FIG. 1, or else some physical barrier may be moved into the path of the articles 14*a* to 14*e* to arrest further movement of the articles 14*a* to 14*e*.

The carriage 22 and printing apparatus 16 are then moved transversely of the lanes a to e of the articles 14*a* to 14*e* with the print head 26 moved out of the printing position. When the printing apparatus 16 has been moved to a position in registry with a first article 14*a* of the set of articles such that the print head 16 is positioned over a part of the article where it is desired to print information, the print head 26 is moved towards the article 14*a* into the printing position as seen in FIG. 1, with the ribbon 31 urged into contact with the article 14*a* between the print head 16 and the article 14*a,* while movement of the carriage 22 and printing apparatus 16 across the lanes a to e continues.

Printing of the information on the article 14*a* may then be commenced. The ribbon 31 will need to be moved by its motive means 34 relative to the print head 16 during printing. Such ribbon 31 movement may be at a speed such that the ribbon 31 and article 14*a* are or are not relatively moving, as desired to achieve a required quality of print. The printing elements 28 will selectively be energised as the carriage 22 and print head 16 continues to move transversely of the lanes a to e to print the desired information. When the information has been printed, the print head 16 is moved away from the article, again while print head 16 and carriage 22 movement transversely of the lanes a to e continues. Preferably ribbon 31 movement relative to the print head 16 is arrested so as not to waste ribbon 31.

The method is repeated as the printing apparatus 16 is moved into registry with a second 14*b* of the articles 14*a* to 14*e,* and then for each of the remaining articles 14*c* to 14*e*.

All the time, the printing apparatus 16 and carriage 22 continue to move transversely of the lanes a to e such that there is no requirement to stop the printing apparatus 16 until information has been printed on all of the articles 14*a* to 14*e* of the set.

Figure 2:
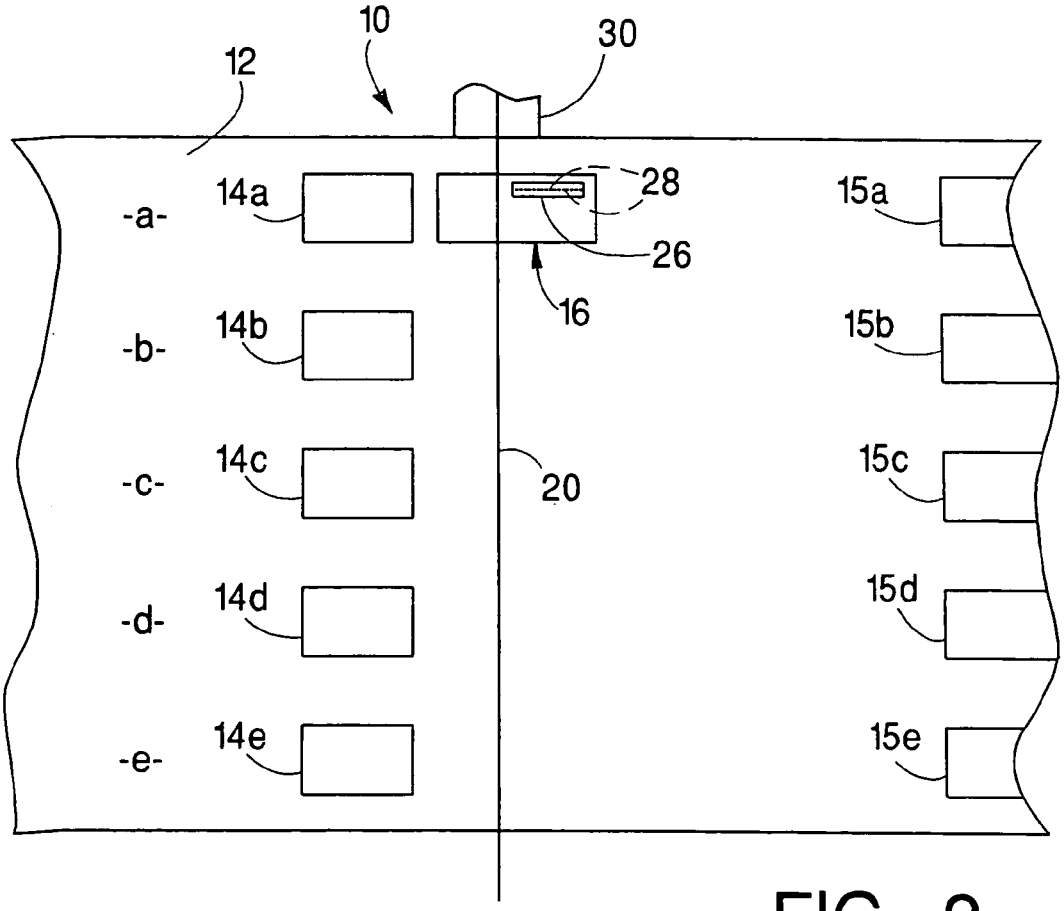
FIG. 2 is an illustrative plan view of the printing station of FIG. 1 but after printing.

When the printing apparatus 16 has printed on the last article 14*e* of the set, the conveying means 12 may be operated, or any physical barrier present removed, to permit the articles 14*a* to 14*e* all to be conveyed in their lanes a to e beyond the printing station 10 as illustrated in FIG. 2, so that the next set of articles 15*a* to 15*e* may be conveyed to the printing station 10 for printing. If desired, as the next set of articles 15*a* to 15*e* are conveyed to the printing station 10, the printing apparatus 16 and carriage 22 may be moved back across the lanes a to e ready to print on the first article 15*a* of the next set, in the first lane a. Alternatively, the information may be printed on each of the next set of auricles 15*a* to 15*e* in a reverse order as the printing apparatus 16 and carriage 22 are moved transversely of the lanes a to e in an opposite direction to the direction of movement of the printing apparatus 16 and carriage 22 during printing on the articles 14*a* to 14*e* of the previous set. In each case though, it is necessary to move the ribbon 31 relative to the print head 26 during printing so that fresh ribbon 31 from which pixels of ink have not already been removed, is continually presented between the print head 26 and the articles on which information is to be printed.

Various modifications in addition to those already mentioned may be made without departing from the scope of the invention. For example, as described the invention has been applied to a printing apparatus of the thermal kind, although may be applied to any other printing apparatus, such as an ink jet or other pixel based printing apparatus, as desired. Thus in such an alternative arrangement, a carrier ribbon for ink may not be required, but the ink may be contained in a carrier reservoir from which it is fed to printing elements or jets of the print head for jetting on to the articles during printing. The invention may be applied to other pixel based and non pixel based systems as desired.

Although in the drawings, a conveying means 12 for conveying a set of five articles is indicated, or course the set of articles may be any plurality of articles in a corresponding number of lanes.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A method of printing information on each article of a set of articles arranged in generally parallel lanes, at a printing station, the method comprising:

providing the printing station including a gantry, a carriage mounted to the gantry, and a printing apparatus having a housing mounted on the carriage, and a print head, the printing apparatus being movable transversely across the lanes;

continuously moving the printing apparatus transversely across the lanes to bring the printing apparatus into registry with each article of the set in turn;

at each registry position, whilst continuing to move the printing apparatus, moving the print head of the apparatus relative to the housing and relative to the respective article to a printing position in which the print head is capable of printing information on the article;

continuing to move the printing apparatus transversely relative to the article whilst effecting printing with the print head; and when the information is printed, whilst continuing to move the printing apparatus transversely, moving the print head relative to the housing out of the printing position.

2. A method according to claim 1 wherein the printing apparatus is continuously moved across the carriage transversely across the lanes, relative to a base structure relative to which each of the articles of the set is held stationary during printing.

3. A method according to claim 2 wherein the carriage is moved transversely of the lanes at a generally constant speed.

4. A method according to claim 1 wherein all of the articles of the set are positioned at the printing station simultaneously whilst the printing apparatus is moved transversely across all the lanes.

5. A method according to claim 1 wherein the articles are conveyed severally in their respective lanes, to the printing station, and are arranged to be present at the printing station so that the printing apparatus may be moved into registry with the articles and printing performed, whilst the printing apparatus is continuously moved.

6. The method according to claim 1, wherein the articles are unconnected and spaced from each other along the generally parallel lanes.

7. A method according to any claim 1 wherein the print head is of the kind having a plurality of printing elements which are selectively actuated during printing by a control means to effect printing of desired information on each of the articles.

8. A method according to claim 1 wherein the printing apparatus is a thermal printer in which there are printing elements arranged in a generally linear array along the print head with the array extending generally transversely to the direction of movement of the printing apparatus across the lanes, the method including selectively energising the printing elements during printing to remove pixels of marking medium from a carrier positioned between the printing elements and the article.

9. A method according to claim 8 wherein the method includes moving the carrier relative to the print head as the printing apparatus moves transversely of the lanes of articles during printing, so as that fresh carrier is continually being positioned between the print head and the article on which information is being printed.

10. A method according to claim 8 wherein the printing apparatus includes a housing within which there is provided a storage spool for unused carrier, a take-up spool for used carrier, a first motive means to move at least the take-up spool to take up used carrier, and a second motive means to move the print head to and from the printing position.

11. A method according to claim 1 which includes conveying the articles of the set in their parallel lanes to the printing station, arresting movement of the set of articles at the printing station while the information is printed on each of the articles of the set.

12. A method of printing information on each article of a set of articles arranged in generally parallel lanes, at a printing station, the method comprising:

continuously moving a printing apparatus relative to the lanes to bring the printing apparatus into registry with each article of the set in turn, the printing apparatus including a print head and a carrier for marking medium which is applied to the articles during printing;

at each registry position, whilst continuing to move the printing apparatus, effecting printing with the print head; and when the information is printed, continuing to move the printing apparatus to the next registry position.

13. A method according to claim 12 wherein the method is applied to printing apparatus having a thermal print head having printing elements which are selectively energised during printing to melt and remove pixels of marking medium from the carrier and deposit the pixels of ink on to the articles.

* * * * *